US007218987B2

(12) United States Patent
Mile et al.

(10) Patent No.: US 7,218,987 B2
(45) Date of Patent: May 15, 2007

(54) TUFTING MACHINE

(75) Inventors: Joz Mile, Alexandria (AU); William Brian Wilson, Alexandria (AU)

(73) Assignee: Wilcom Pty Ltd (AU)

( * ) Notice: Subject to any disclaimer, the term of this patent is extended or adjusted under 35 U.S.C. 154(b) by 0 days.

(21) Appl. No.: 11/315,142

(22) Filed: Dec. 23, 2005

(65) Prior Publication Data

US 2006/0137581 A1 Jun. 29, 2006

(30) Foreign Application Priority Data

Dec. 23, 2004 (AU) ..... 2004907392

(51) Int. Cl.
*D05C 15/08* (2006.01)

(52) U.S. Cl. ..... 700/137; 112/80.3

(58) Field of Classification Search ..... 112/80.3, 112/475.23, 80.23, 80.31, 80.54, 80.55; 700/135–137
See application file for complete search history.

(56) References Cited

U.S. PATENT DOCUMENTS

| | | | | |
|---|---|---|---|---|
| 3,144,844 A | | 8/1964 | Elliott et al. | |
| 3,389,667 A | | 6/1968 | Mueller | |
| 3,968,758 A | | 7/1976 | Scholz | |
| 4,488,498 A | | 12/1984 | Smith | |
| 5,158,027 A | * | 10/1992 | Ingram | 112/80.08 |
| 5,165,352 A | * | 11/1992 | Ingram | 112/80.08 |
| 5,503,092 A | | 4/1996 | Aubourg et al. | |
| 5,662,054 A | * | 9/1997 | Bardsley | 112/80.18 |
| 5,829,372 A | | 11/1998 | Aubourg et al. | |
| 5,979,344 A | * | 11/1999 | Christman, Jr. | 112/80.23 |
| 6,263,811 B1 | * | 7/2001 | Crossley | 112/80.4 |
| 6,273,011 B1 | * | 8/2001 | Amos | 112/80.7 |
| 6,293,211 B1 | * | 9/2001 | Samilo | 112/80.16 |

FOREIGN PATENT DOCUMENTS

| | | |
|---|---|---|
| DE | 28 15 801 | 10/1979 |
| EP | 0 547 738 A1 | 6/1993 |
| EP | 0 547 738 B1 | 2/1996 |
| GB | 1063180 | 3/1967 |

OTHER PUBLICATIONS

European Search Report

* cited by examiner

*Primary Examiner*—Danny Worrell
(74) *Attorney, Agent, or Firm*—Kenneth M. Fagin, Esq.

(57) ABSTRACT

This invention concerns the production of so called "hand tufted rugs", carpets and wall hangings by use a "tufting machine" which employs a single hollow needle through which yarn is fed into a backing fabric, to form tufts of yarn. The machine comprises a yarn cutter, in the tufting head, which is selectively operable to cause the tufts to be cut or loop pile. A computer operated motion control system is operable under the control of a machine readable tufting design pattern comprising a series of vectors and associated control codes, to drive the tufting gun as follows: (a) to operate the mechanism and reciprocate the needle to insert tufts into backing fabric. (b) to operate the movement system and move the needle across a two-dimensional plane while inserting tufts, in accordance with the vectors. (c) to lift and lower the foot, in accordance with respective control codes. And, (d) to selectively operate the yarn cutter, in accordance with respective control codes.

17 Claims, 8 Drawing Sheets

TUFTING MACHINE

TECHNICAL FIELD

This invention concerns the production of so called "hand tufted rugs", carpets and wall hangings by using a "tufting gun" which employs a single hollow needle through which yarn is fed by high pressure air or by mechanical means, into a backing fabric, to form tufts of yarn. The tufts may be cut pile or loop pile. Such "tufting guns" may be controlled and guided manually by a human operator, or as in this invention, automatically in the context of a computer controlled tufting machine that uses vector based design definition.

BACKGROUND ART

"Broad loom tufting machines" typically use a row of several hundred needles to insert row after row of tufts simultaneously into backing fabric which is drawn continuously passed them. Such large scale machines commonly use needles which have an eye to carry the yarn through the backing. It is common practice in broadloom tufting machines to switch between cut pile and loop pile on a stitch by stitch basis, or area by area basis, automatically, and under the control of bit map design data from a design system. Cutting of the yarn is generally done after tuft insertion by means located on the opposite side of the backing fabric to the needles.

U.S. Pat. No. 3,389,667 (H. C. Mueller) describes an early hand-held tufting gun. This gun uses a single hollow needle, and incorporates a cutting mechanism that cooperates with the needle's reciprocating action to produce cut pile. The cutting mechanism is manually engaged and disengaged to switch between cut and loop pile. The patent also describes a ganged arrangement where the cutting mechanism associated with each needle is controlled by a respective pattern chain which determines whether the cutting mechanism is activated or not in any given tufting cycle. The Hartleb (see DE 2,815,801) and Scholz (see U.S. Pat. No. 3,968,758) hand-held tufting guns are further examples of earlier types of hand guns to which a linear action cutter and a rotary action cutter can be manually engaged and disengaged.

Modern hand-held tufting guns use a hollow needle and a mechanism to cut the yarn after it is inserted in the backing fabric. To switch between cut and loop pile the cutting mechanism must be manually engaged and disengaged, which is tedious and time consuming. At least one manufacturer recommends that two machines be used sequentially, one for cut pile and the other for loop pile.

As a result the carpets and rugs produced by hollow needle tufting guns, whether by hand or by automatic machines, have tended to be constructed entirely of cut pile, or entirely of loop pile. When a mixture of cut pile and loop pile is desired, it is typical to restrict the switching between cut and loop to relatively large and well defined areas of color. It is problematic to have designs in which small runs of cut pile are interspersed with small areas of loop pile. But, there is a growing demand for new textured effects in tufted carpet, including designs which intermingle cut pile and loop pile effects frequently.

A fully mechanical type of hand held tufting gun uses a forked blade, rather than air, to push the yarn through the hollow needle. Machines of this type are able to use a yarn brake so that the forked blade can be used to cut the yarn and produce cut pile. Where loop pile is to be produced the blade is required only to push the yarn into place and not to cut it, and the yarn brake is dispensed with or immobilized. This adjustment can be simple relative to the adjustments required to convert the operation of the pneumatic machines, and a solenoid operated yarn brake can be used to automate the change over. However, it is recommended to change the sharp forked blade for a blunt one when producing loop pile, so that inadvertent damage to the yarn is avoided. Naturally, the sharp blade must be restored when switching back to cut pile.

Furthermore, the forked blade type of machine is unable to offer some of the stitching capabilities of the pneumatic machines, such as the ability to reliably tuft and cut some types of non-woolen yarns, especially when multiple ends of different thickness yarns are tufted simultaneously. The production of exaggerated "J" shaped cut pile tufts is not possible, since both legs of the tuft produced are essentially the same length, making a "U" shaped tuft.

The hollow needle used for this type of tufting has a sharp point created by cutting the cylindrical needle at an angle of 45 degrees. In operation the needle must be oriented such that the tip faces the direction of tufting. When the direction of tufting changes, so must the needle. This is accomplished with manually controlled handguns typically by rotating the entire tufting gun about a hand held swivel, in a range of approximately 180 degrees. This is problematic for automatic operation for several reasons: The yarn feed, electrical supply wires, and pneumatic supply hoses required for operation prevent the head from being rotated continuously through multiple turns. The mass of the parts that must be rotated restrict the rotational speed which reduces the overall speed with which automated tufting machine can be driven, reducing productivity of the machine. Various techniques have been used in the past for rotating the entire or a portion of the tufting mechanism, for example as described in Wilcom Tufting's earlier patent U.S. Pat. No. 5,829,372 which uses a mechanical "needle and blade" tufting mechanism. These are not adaptable for use in pneumatic tufting guns such as the Hartleb type gun described in DE 2,815,801.

Wilcom Tufting Pty Ltd has another earlier U.S. Pat. No. 5,503,092 and this together with U.S. Pat. No. 5,829,372 give details of the tufting and cutting cycles of operation.

None of the mechanisms proposed or used for automatically changing between cut and loop pile in broad loom or ganged arrangements of tufting machines have proved to be adaptable to single needle tufting guns, whether guided manually by a human operator, or automatically via a computer controlled machine using vector based design definition.

DISCLOSURE OF THE INVENTION

The invention is a tufting machine, comprising:

a tufting head which comprises:

(a) a tufting mechanism having a cyclic mode of operation;

(b) a hollow needle mounted in the mechanism that is moveable relative to a cooperating foot in a reciprocating manner to insert a tuft of yarn into backing fabric in each cycle;

(c) a yarn cutter mounted in the mechanism that is selectively operable to cut the yarn in selected cycles to produce loop or cut pile; and, a computer operated motion control system; wherein, the control system is operable under the control of a machine readable tufting design pattern comprising a series of vectors and associated control codes, to drive the tufting gun as follows:

(d) to operate the mechanism and reciprocate the needle to insert tufts into backing fabric;

(e) to operate the movement system and move the needle across a two-dimensional plane while inserting tufts in accordance with the vectors;

(f) to lift and lower the foot, in accordance with respective control codes; and, (g) to selectively operate the yarn cutter, in accordance with respective control codes.

The tufting machine may be operated to produce a tufted pattern having both cut and loop pile. It is able to automatically switch between tufting areas of cut pile and areas of loop pile. The machine is also able to automatically raise the foot and operate the yarn cutter at the ends of a section of loop pile, so that it can then traverse to another disconnected section of the design. The foot is generally raised and lowered by moving the entire tufting head relative to the backing fabric.

The tufting head may involve a pneumatic yarn feed, in which case the yarn is fed through the hollow needle by compressed air into backing fabric to form tufts of yarn. Alternatively the tufting head may be entirely mechanical, utilizing a forked blade within the needle to push the yarn into the backing fabric.

The yarn cutter may be arranged in a variety of different ways in order to achieve selective operation. In general the yarn cutter moves through its own cutting cycle as the tufting mechanism moves through a tufting cycle. In one arrangement the cutter may be selectively rendered operable by being engaged to move through its cutting cycle, or be disengaged and stationary during selected tufting cycles. In an alternative the cutter may be allowed to cycle in every tufting cycle, but be moved between a cutting position where the yarn is cut each cycle, and another position in which the yarn is not cut.

A blade in the yarn cutter may be employed to perform the cutting operation. The blade may be arranged to move during the cutting cycle in a linear fashion back and forth across the axis of the tufting needle. Alternatively, the blade may be moved in a rotary fashion about the tufting needle axis.

The control system is able to read tufting design patterns, comprising a series of vectors and associated control codes, in which a large number of parameters may be used to vary different aspects of tufting. For example:

Stitch Length;
Pile Height;
J-Stitching Pile Heights;
Cut Pile;
Loop Pile;
Raise Foot or Tufting Head;
Lower Foot or Tufting Head;
Cut Yarn;
Enable Yarn Cutter;
Disable Yarn Cutter;
Change Colour.

The tufting needle may be mounted in the tufting mechanism in a manner that allows it to be rotated freely in either direction about its axis. The foot and needle may comprise interengaging formations so that the needle may be driven in rotation by the foot. The foot may be driven in rotation by any suitable mechanism.

In a further aspect the invention is a tufting machine head, comprising:

a tufting mechanism having a cyclic mode of operation;

a foot to engage backing fabric during tufting; and a hollow needle mounted in the mechanism that is moveable relative to the foot in a reciprocating manner to insert a tuft of yarn into backing fabric in each cycle;

wherein the needle is mounted in the tufting mechanism in a manner that allows it to be rotated freely in either direction about its axis; and, the foot and needle comprise interengaging formations so that the needle may be driven in rotation by the foot.

The foot may be driven in rotation by any suitable mechanism. For instance, the formations on the needle may comprise flats on its outer surface. The foot may be in the form of a yoke that extends across the axis of the needle. The needle may pass through a hole in the yoke, and the formations on the foot may be in form of tabs on the inner surface of the hole that engage the flats on the needle.

The ends of the yoke may be fixedly mounted on the circumference of a wheel that is driven in rotation.

BRIEF DESCRIPTION OF THE DRAWINGS

An example of the invention will now be described with reference to a modified Hartleb pneumatic tufting gun, as referenced above, and the accompanying drawings, in which:

FIGS. 4 to 7 each include a scratch section showing the relationship between the needle and blade of the yarn cutter.

FIG. 8(*b*) is an exploded view of the needle and foot from the rear.

BEST MODES OF THE INVENTION

Figure 1:
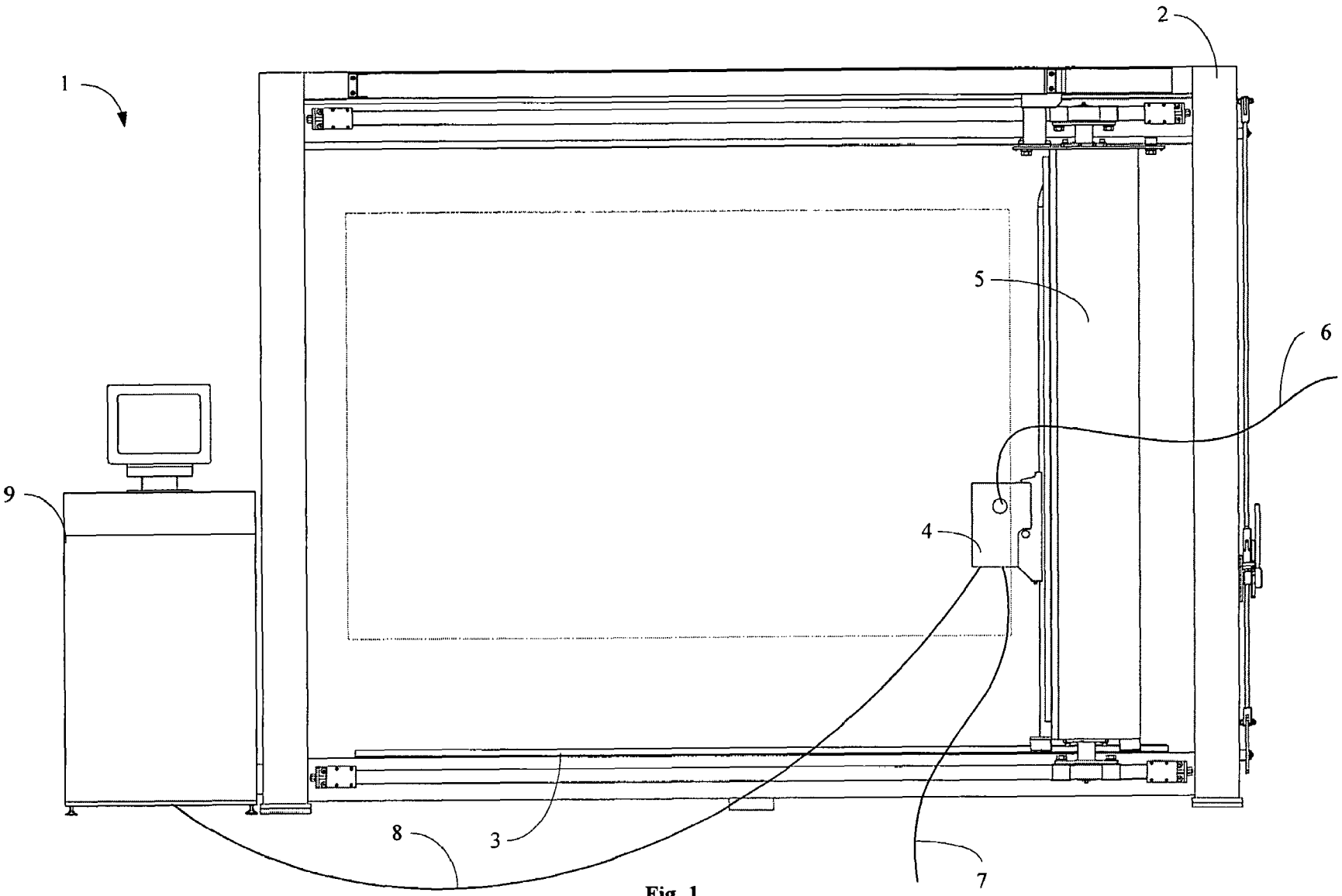
FIG. 1 is a pictorial diagram of a tufting machine.

Referring first to FIG. 1 tufting machine 1 comprises a stand 2 onto which a stretch frame 3 can be mounted. In use, backing fabric is mounted on stretch frame 3. A tufting head 4 is also mounted on the stand in a movement system 5 that is able to translate in X- and Y-directions over the backing fabric. Yarn 6 is provided to the tufting head 4, as well as compressed air 7, electrical power and control signals 8. The control signals 8 are supplied from a computer control system 9 which is operable under the control of a machine readable tufting design pattern comprising a series of vectors and associated control codes.

Figure 2:
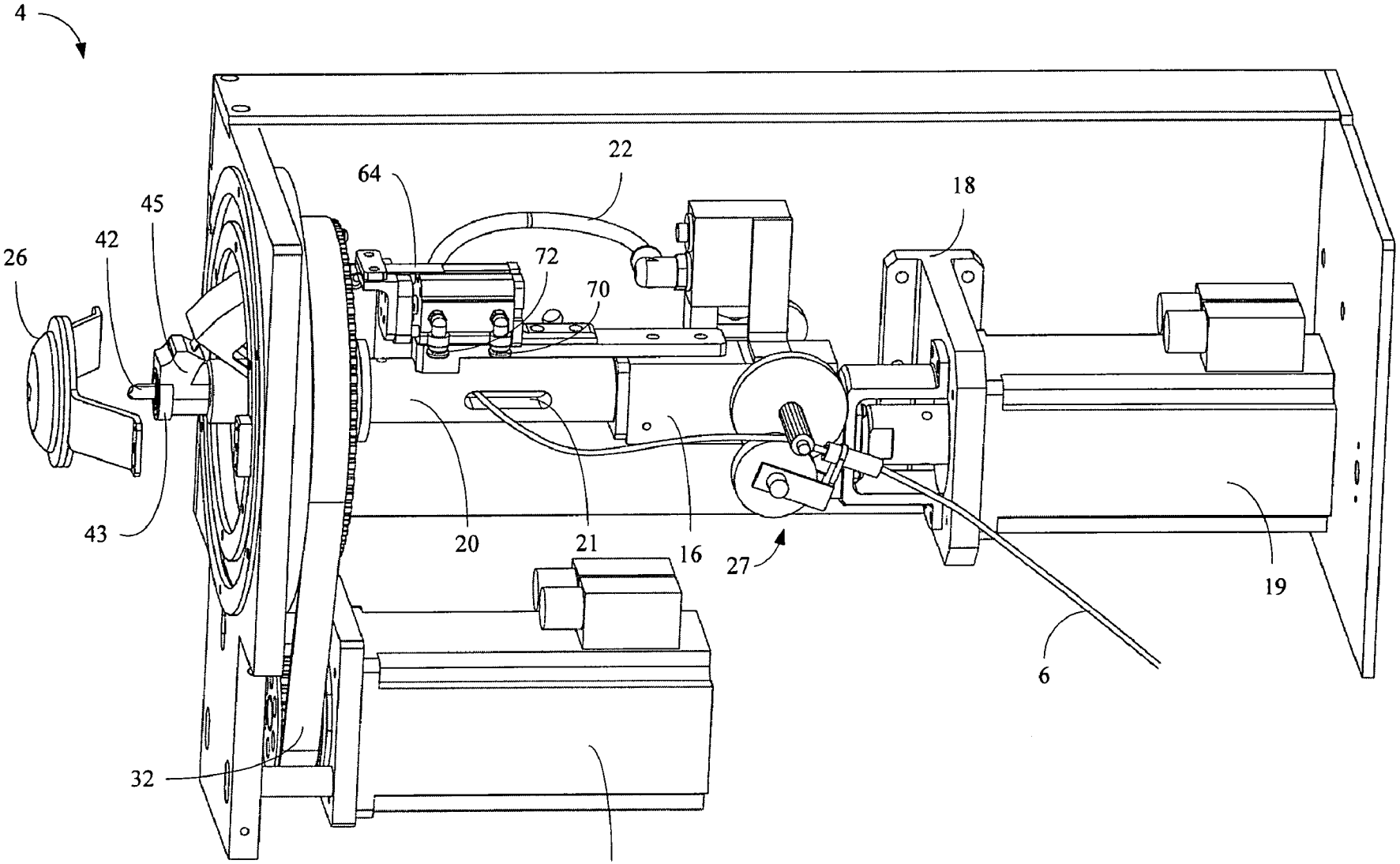
FIG. 2 is a pictorial diagram of a tufting head from the front and left side.
Figure 3:
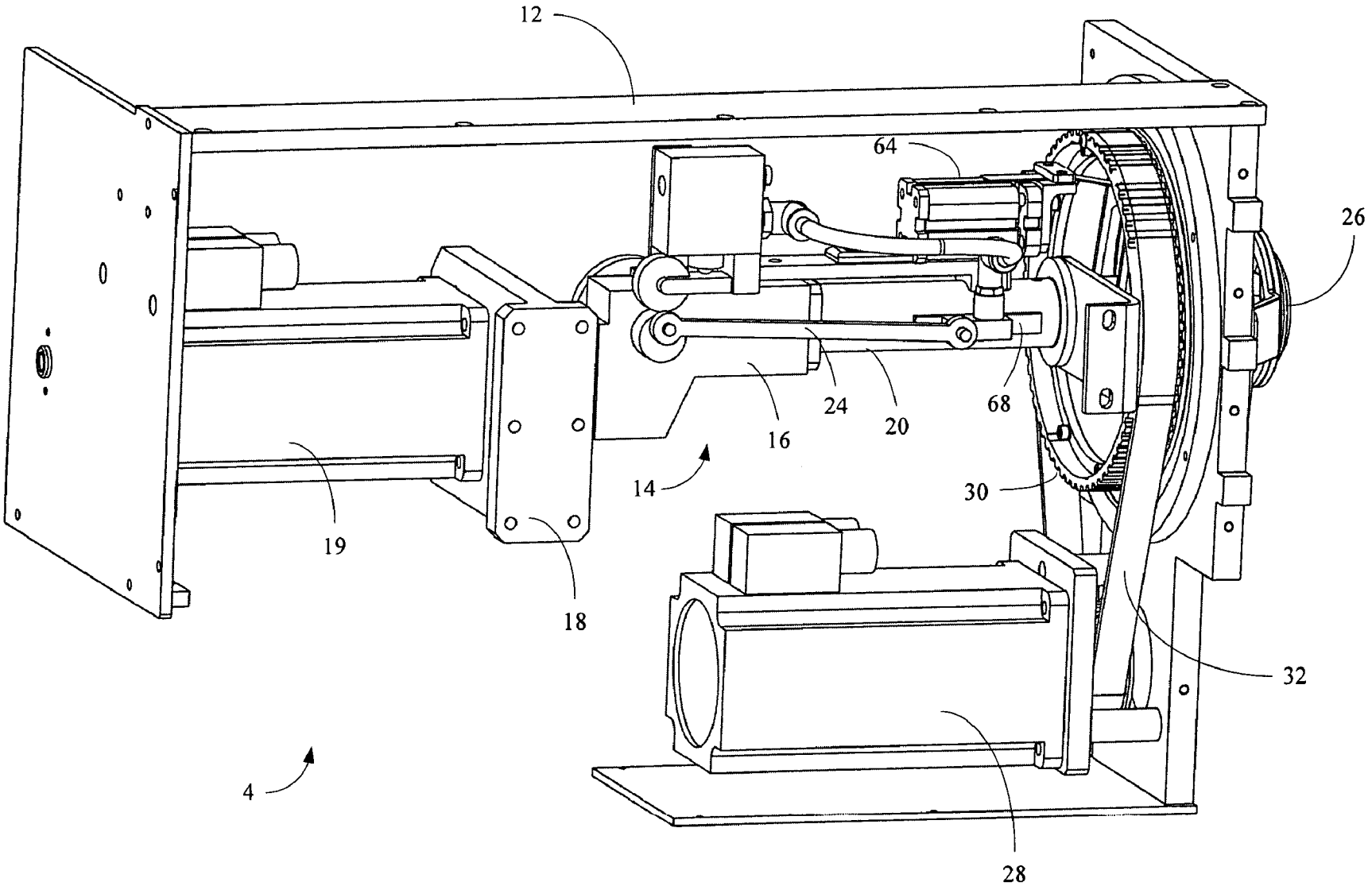
FIG. 3 is a pictorial diagram of the tufting head from the right side.

Referring to FIGS. 2 and 3, the tufting head 4 comprises a frame 12 in which is mounted a tufting mechanism, indicated generally at 14. The mechanism 14 has a gearbox 16 that is mounted to a motor mounting bracket 18 which holds motor 19 in the frame 12. A tufting head barrel 20 extends forwardly from gearbox 16.

Within barrel 20 is a reciprocating inner barrel (not shown in FIG. 3) through which yarn 6 is supplied via slot 21 in the barrel to a hollow needle (not shown in 3). Compressed air is fed to the yarn tube via pipe 22 to drive the yarn down through the inner barrel to the needle at the correct point in the reciprocating motion, when the needle has pierced the backing fabric. In use electric motor 19 provides drive to gearbox 16. Gearbox 16 translates the rotary motion of the motor 19 through ninety degrees to drive rotary motion of an eccentric and crank 24. Crank 24 engages the inner barrel via slot 68 to reciprocate the needle up and down through foot 26. Gearbox 16 also drives yarn feed pinch-wheels indicated generally at 27. The yarn 6 is pulled from its supply by these wheels and fed into slot 21. A second electric motor 28 drives a wheel 30 via a belt 32 to rotate the foot and the needle.

Referring now to FIGS. 4 to 7, a yarn tube 40, which is within the reciprocating inner barrel 66, and hollow needle 42 are now visible, as is a needle bearing 43 and needle holder 45. A yarn cutter, indicated generally at 44, is mounted in the mechanism to cut the yarn in selected cycles to produce loop or cut pile. The yarn cutter comprises an elongated blade 50 mounted in a blade holder 52 so that it extends parallel to the axis 60 of needle 42. An arm 54 is pivoted from the inner barrel 66 at 56 and has rollers (not shown) through which the blade 50 is passed to curve it so that the cutting tip 58 is advanced toward the yarn tube 40 and needle axis 60.

Figure 4:
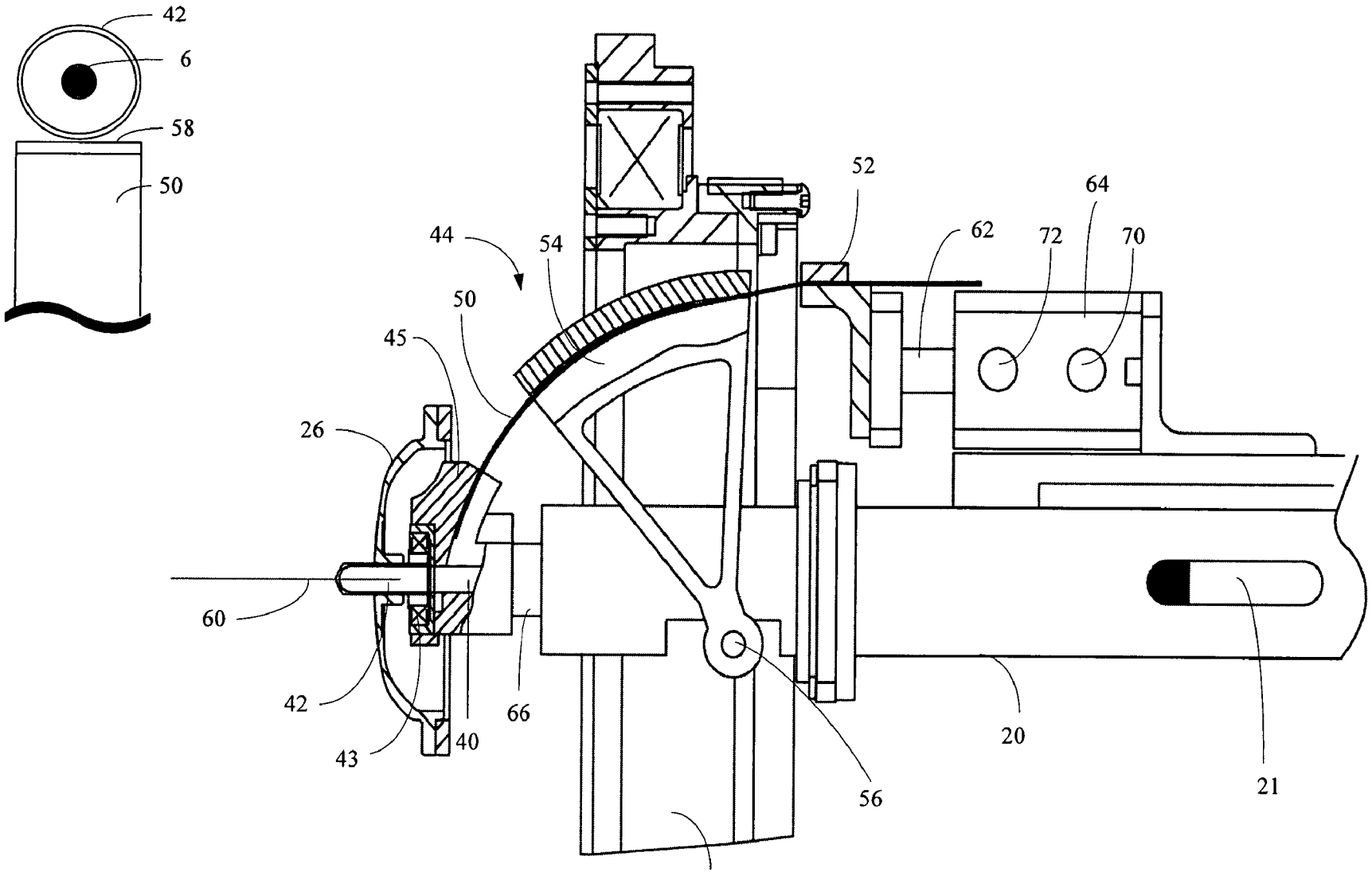
FIG. 4 is a sectional view of part of a tufting head from the side in a first configuration where the yarn cutter is engaged but the blade is not in the cutting position.

Blade holder 52 is mounted on the end of a piston 62 extending from a pneumatic cylinder 64. In FIG. 4 piston 62 is extended and the yarn cutter 44 is engaged. Also in FIG. 4 it can be seen that the needle 42 is advanced through foot 26 to deliver yarn into the backing fabric. The advance of the needle can be seen by the extension of inner barrel 66 from barrel 20, and also by the end of inner barrel 66 visible at slot 21. The yarn 6 is fed into inner barrel 66 at its end which is accessible by slot 21.

Figure 5:
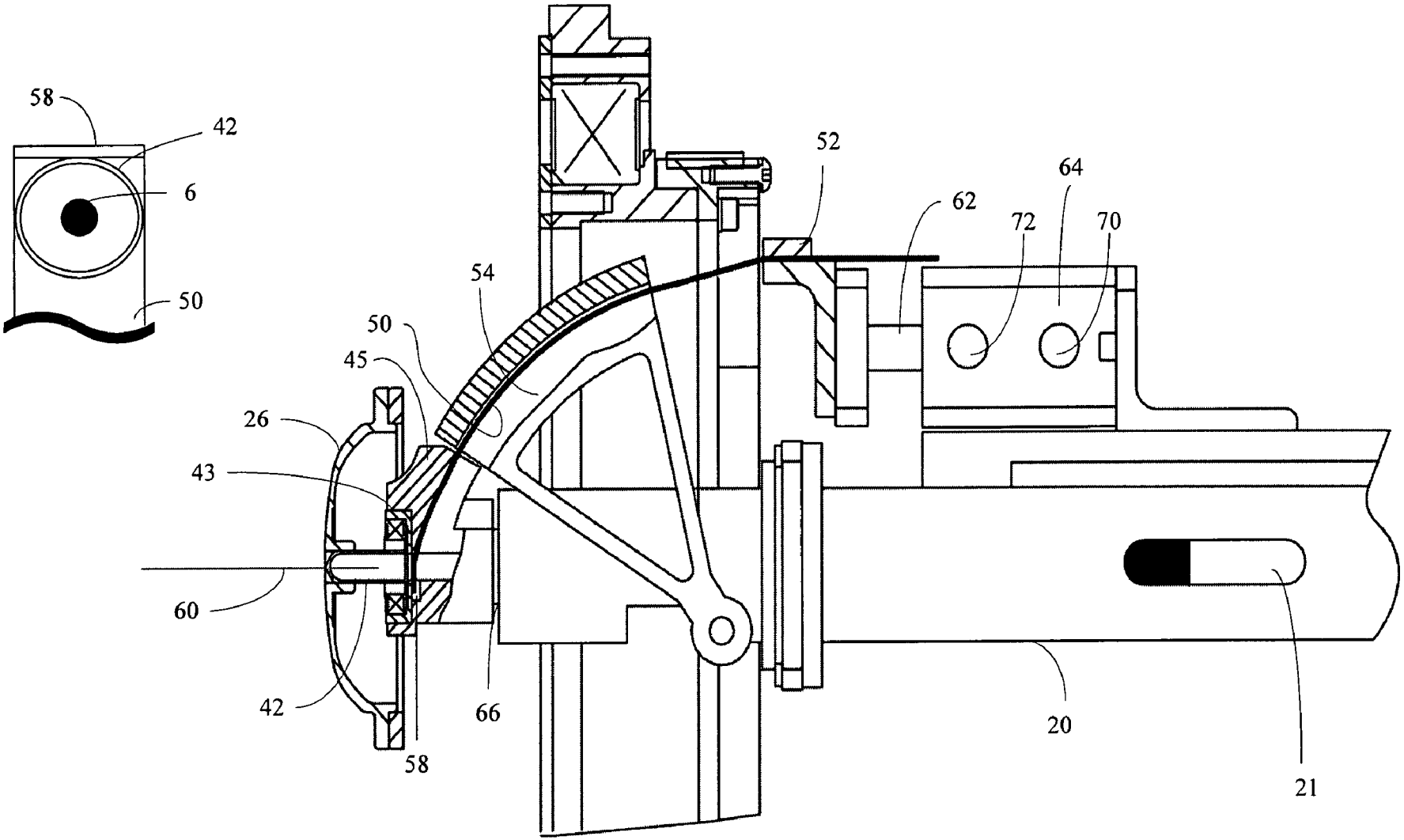
FIG. 5 is a sectional view of part of a tufting head from the side in a first configuration where the yarn cutter is engaged and the blade is in the cutting position.

In FIG. 5 piston 62 remains extended and the yarn cutter 44 is still engaged. However, needle 42 has been withdrawn from foot 26 and inner barrel 66 is seen to be withdrawn into barrel 20; as can also be seen in slot 21. As a result of the movement of the needle the tip 58 of blade 50 is advanced across the back of the needle holder 45 past axis 60 and therefore cuts the yarn 6. Since during each tufting cycle the inner barrel 66 which supports the needle holder 45 and the needle 42 is reciprocated inside the stationary outer support barrel 20, the blade 50 will cut the yarn 6 in each tufting cycle. As a result the machine will produce cut pile.

Figure 6:
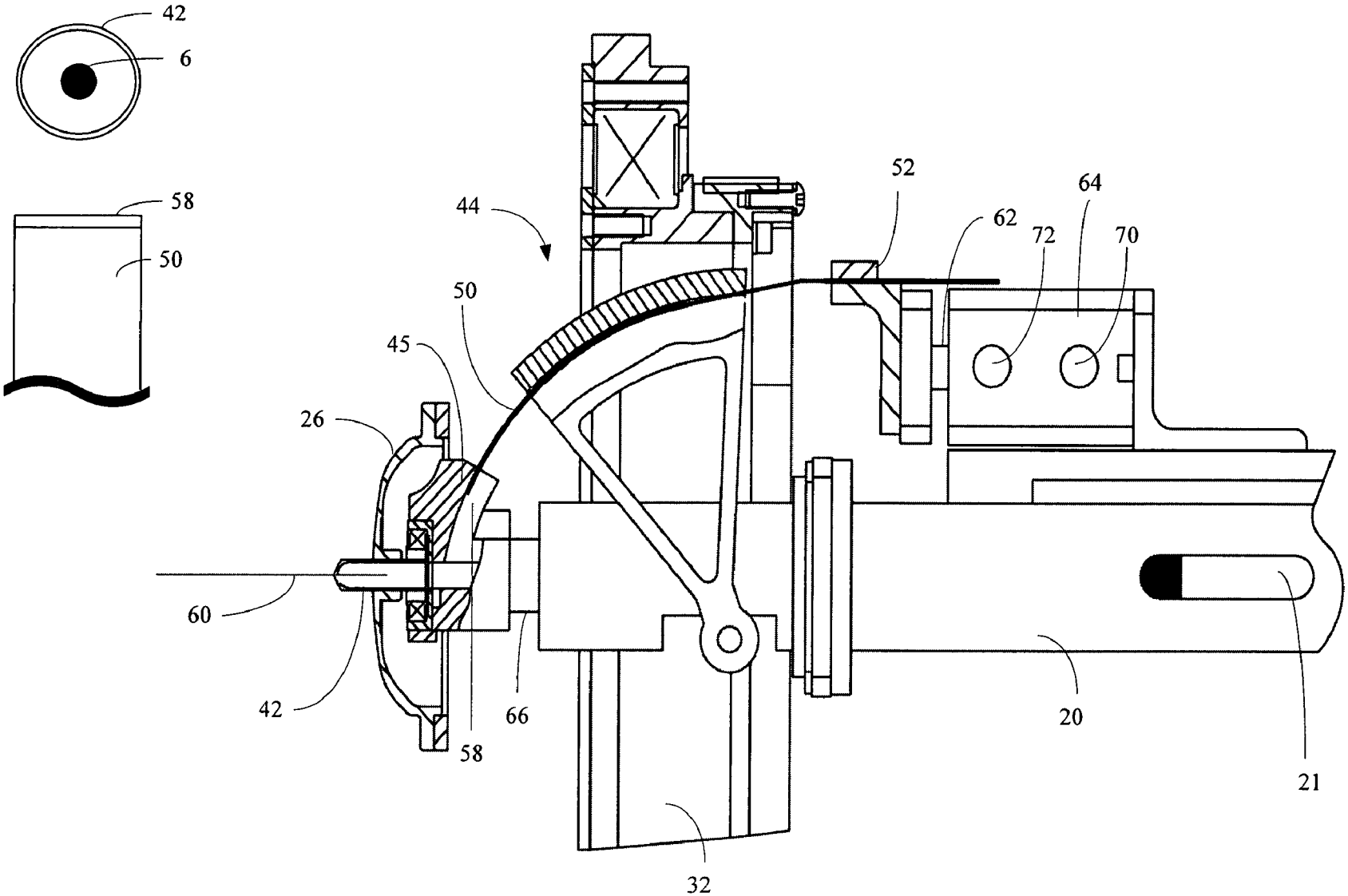
FIG. 6 is a sectional view of part of a tufting head from the side in a second configuration where the yarn cutter is disengaged and the blade is not in a cutting position.

In FIG. 6 it can be seen that the needle 42 is advanced through foot 26 to deliver yarn into the backing fabric. The advance of the needle can again be seen by the extension of inner barrel 66 from barrel 20, and also at slot 21. In this case piston 62 is retracted into cylinder 64 and the yarn cutter 44 is disengaged. As a result the tip 58 of blade 50 is withdrawn far from needle 42.

Figure 7:
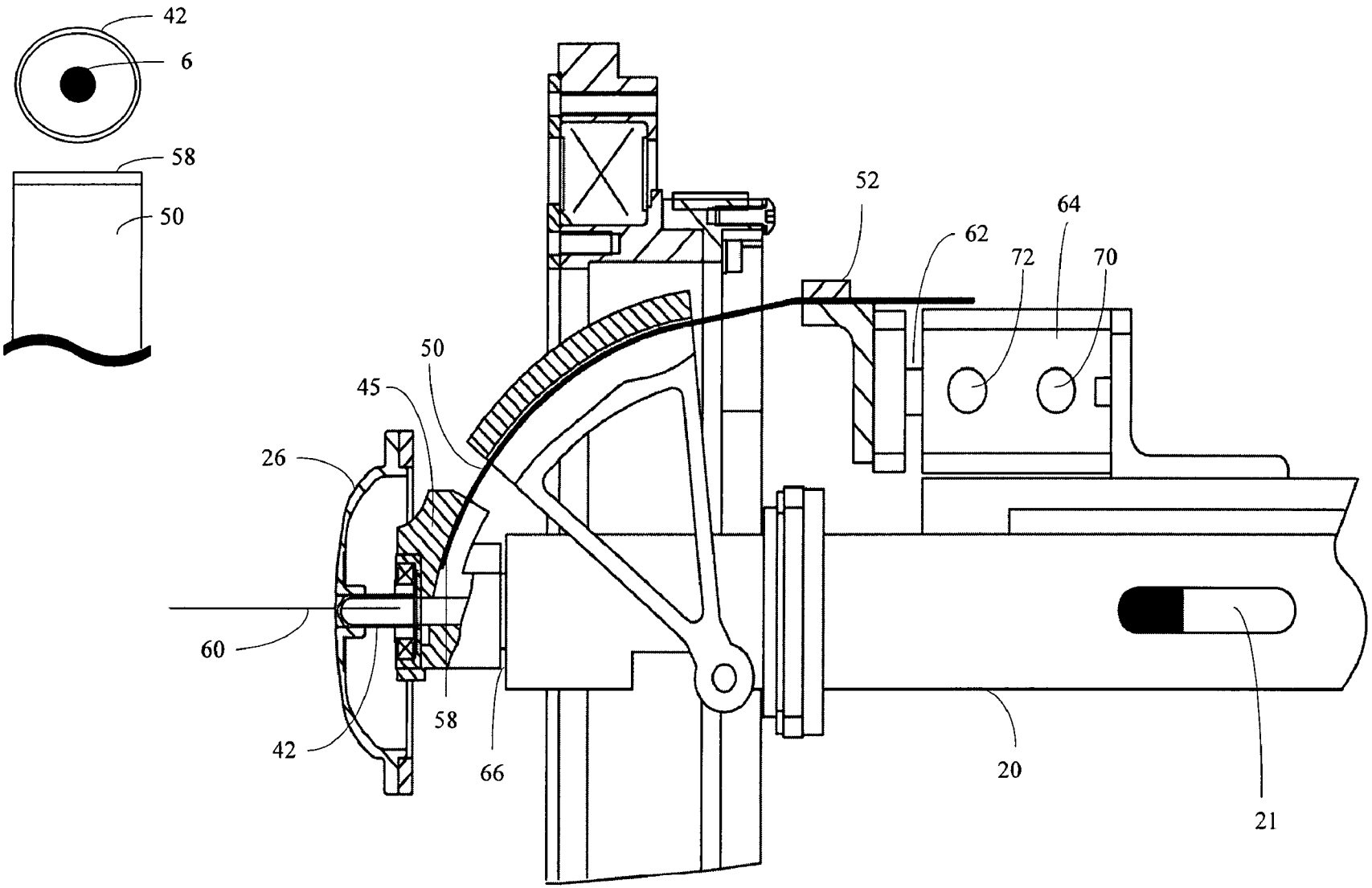
FIG. 7 is a sectional view of part of a tufting head from the side in the second configuration where the yarn cutter is disengaged and the blade is not in a cutting position.

In FIG. 7 piston 62 remains withdrawn and the yarn cutter 44 is still disengaged. However, needle 42 has been withdrawn from foot 26 and inner barrel 66 is seen to be withdrawn into barrel 20; see also slot 21. As a result of the movement of the needle the tip 58 of blade 50 is advanced towards the needle mount 45 but does not pass behind needle 42 and therefore does not cut the yarn. As a result the machine will produce loop pile.

By selectively operating cylinder 64 and piston 62 the tufting head is selectively and automatically switched between producing cut and loop pile. Cylinder is operated by compressed air supplied through two air inlet ports 70 and 72 via pneumatic hoses which drive it positively to extend and retract piston 62.

The tufting machine is operated by a computer operated control system having a number of degrees of freedom. The control system is operable under the control of a machine readable tufting design pattern. The tufting design pattern for a tufted rug is prepared by a designer using a CAD system. The structure of the design pattern produced by the CAD system is essentially a series of vectors with associated control codes. The vector end points define the path along which to tuft, and the control codes contain parameters to define the tufting that should be done.

The designer might specify required combinations of Pile parameters into numbered Pile Specifications, and then assign the desired Pile Specification to vectors in the design. This can alternatively be done in the control system itself.

The following tables exemplify Pile Specification values and Vector tufting commands.

Pile Specification Values:

| Pile Spec # | Cut/Loop | Stitch Length (millimeters) | Pile Height A (millimeters) | Pile Height B (millimeters) |
|---|---|---|---|---|
| 1 | Loop | 4.0 | 16.0 | — |
| 2 | Loop | 5.0 | 16.0 | — |
| 3 | Cut | 4.0 | 16.0 | — |
| 4 | Cut | 5.0 | 16.0 | — |
| 5 | Cut | 4.0 | 16.0 | 35.0 |

Table of Vector Tufting Commands

| X | Y | Function | Pile ID |
|---|---|---|---|
| x1 | y1 | Move | — |
| x2 | y2 | Tuft | Pile Spec 1 |
| x3 | y3 | Tuft | Pile Spec 2 |
| x4 | y4 | Tuft | Pile Spec 2 |
| x5 | y5 | Move | — |
| x6 | y6 | Tuft | Pile Spec 1 |
| x7 | y7 | Tuft | Pile Spec 1 |
| . . . | | | |
| 0 | 0 | Move | |

For Cut Pile, when Pile Height A equals Pile Height B, (or if Pile Height B is undefined) then "U" shaped cut piles are designated, of equal height.

When Pile Height A is different that Pile Height B, then "J" shaped cut piles are designated, where A specifies the first part and B the second part.

In operation, the tufting machine's control system reads the vector commands and their associated functions and parameters, and generates control signals for the tufting machine's various motors and actuators to effect tufting of the desired geometry defined by vectors, with the specified pile attributes; such as cut or loop, which stitch length, etc.

When the tufting machine's control system reads from the design file a command to set a parameter value which it can change automatically, it does so without requiring input from a human operator. When the controller reads a command which requires manual intervention, the machine automatically stops, and alerts the human operator that manual intervention is needed, displays on the controller screen which parameter value(s) in the pile specification or yarn specification must be changed, and to which value, and waits for the operator to make the required adjustments, and press the Go button again.

It is understood that this means of referencing a pile specification could also be implemented whereby each parameter value was independently set or referenced, instead of being combined as a Pile Specification ID#.

| X | Y | Function | Parameters |
|---|---|---|---|
| x1 | y1 | Move | |
| x2 | y2 | Tuft | Pile Type = t1, Pile Height = h1, Stitch Length = s1 |
| x3 | y3 | Tuft | Pile Type = t2, Pile Height = h2, Stitch length = s2 |
| x4 | y4 | Tuft | Pile Type = t2, Pile Height = h2, Stitch length = s2 |
| x5 | y5 | Move | |
| x6 | y6 | Tuft | Pile Type = t1, Pile Height = h1, Stitch Length = s1 |
| x7 | y7 | Tuft | Pile Type = t1, Pile Height = h1, Stitch Length = s1 |
| 0 | 0 | Move | |

Since the vectors have magnitude and direction they generally define a two-dimensional motion of the tufting needle across the backing fabric between each cycle of the tufting mechanism. The vectors are typically long in relation to the stitch length, in which case many adjacent tufts spaced at the stitch length are produced along the vector path. Sequences of tuft vectors are tufted in a continuous path.

When a Move command is encountered the needle reciprocating motion is ceased with the needle in the fully retracted position, and the head lifted. In the case of loop pile, the cutter is then activated once and then deactivated again before the XY mechanism is moved to the start point of the next tuft vector.

Figure 8A:
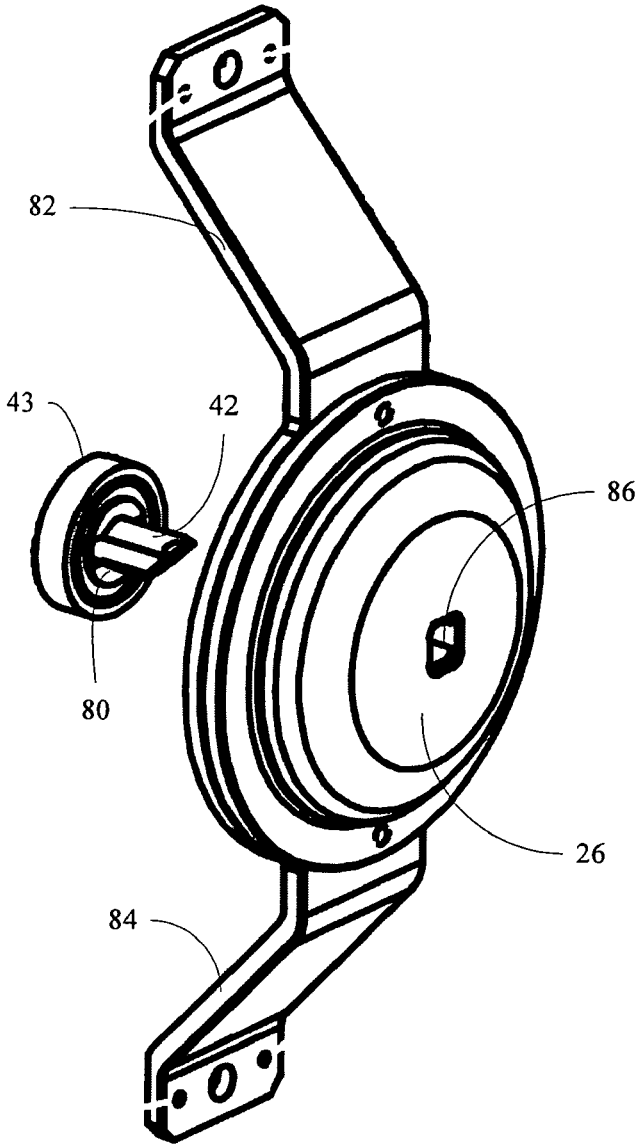
FIG. 8(*a*) is an exploded view of the needle and foot from the front.
Figure 8B:
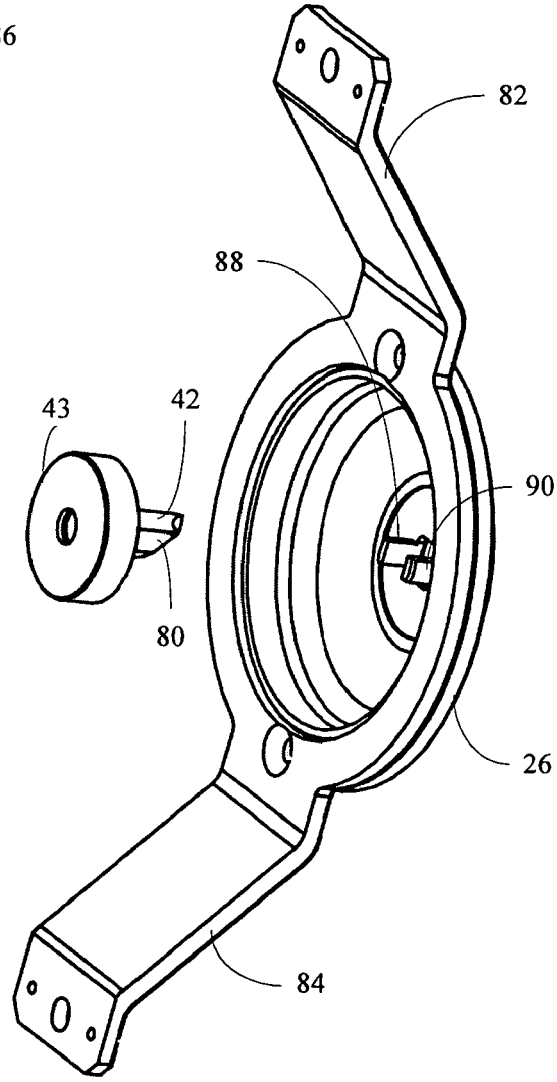

FIGS. 8(*a*) and (*b*) show an exploded view of the needle 42, needle bearing 43 and foot 26. The cylindrical needle 42 has a round cross-section and is formed with opposing flats, one of which 80 is shown. The base of the cylindrical needle 42 is rotatably mounted in needle bearing 43 in a manner that permits unrestricted rotation of the needle. The needle bearing in turn sits within a needle holder 45 formed at the end of inner barrel 66.

The foot 26 is in the form of a yoke with straps 82 and 84 to hold it in front of the tufting machine. The straps engage wheel 30 so that the foot 26 turns when motor 28 drives belt 32 to do so. The foot 26 has a central hole 86 through which the tip and sides of the cylindrical needle 42 pass. Formations in the form of a pair of tabs 88 and 90 extend rearwards from either side of the hole 86. The tabs 88 and 90 are complimentary with the flats 80 of the cylindrical needle 42 and engage the flats to rotate the needle 42 when the foot 26 is turned by motor 28.

Advantageously the rotation of the foot 26 is translated to the needle 42. This minimises the mechanical and electrical complications associated with turning the needle in the prior art arrangements. Moreover, a range of pneumatic hand tufting guns are able to be modified, allowing them to be used on an automated hand gun tufting machine. This is preferable rather than having to design and build a hand tufting gun specifically for an automated hand gun tufting machine.

It will be appreciated that in other examples the shape of the foot and needle may differ from that described above with the exception that the needle and foot are still equipped with complimentary formations which engage each other.

Although the invention has been described with reference to a particular example it should be appreciated that it may be exemplified in many other forms. For instance the needle mounting and engagement between the needle and foot can be achieved in many different ways according to the skill of the designer. Similarly the tufting design pattern may be represented in many different formats provided it still indicates movement over the backing fabric by vectors which have associated control codes.

The invention claimed is:

1. A tufting machine, comprising:

1) a tufting head translatable within said tufting machine in X- and Y-directions by means of a movement system, which tufting head comprises:

a tufting mechanism having a cyclic mode of operation;

a hollow needle mounted in the tufting mechanism that is moveable relative to a cooperating foot in a reciprocating manner to insert a tuft of yarn into backing fabric in each cycle; and a yarn cutter mounted in the tufting head that is selectively operable to cut the yarn in selected cycles to produce loop or cut pile; and, 2) a computer-operated motion control system; adapted to read a machine-readable tufting design pattern comprising a series of vectors and associated control codes and, in response thereto, to generate signals to drive the tufting head a) to operate the tufting mechanism and reciprocate the needle to insert tufts into backing fabric; (b) to operate the movement system and move the needle across a two-dimensional plane defined by said X- and Y-directions while inserting tufts in accordance with the vectors; (c) to lift and lower the foot in accordance with respective control codes; and d) to selectively operate the yarn cutter in accordance with respective control codes.

2. A tufting machine according to claim 1, wherein the tufting head uses compressed air to transport the yarn through the hollow needle and into the backing fabric.

3. A tufting machine according to claim 1, wherein the head uses a forked blade within the needle to transport the yarn through the hollow needle into the backing fabric.

4. A tufting machine according to claim 1, wherein the cutter is selectively rendered operable by being engaged to move through its cutting cycle, or by being disengaged and stationary during selected tufting cycles.

5. A tufting machine according to claim 1, wherein the cutter is allowed to cycle in every tufting cycle, but is moved between a cutting position where the yarn is cut each cycle, and another position in which the yarn is not cut.

6. A tufting machine according to claim 1, wherein a blade in the yarn cutter is arranged to move during the cutting cycle back and forth across the axis of the tufting needle.

7. A tufting machine according to claim 1, wherein a blade in the yarn cutter is moved in a rotary fashion about the tufting needle axis.

8. A tufting machine according to claim 1, wherein the control system is able to read the tufting design patterns, including one or more parameters selected from the following list:

Stitch Length;
Pile Height;
i-Stitching Pile Heights;
Cut Pile;
Loop Pile;
Raise Foot or Tufting Head;
Lower Foot or Tufting Head;
Cut Yam;
Enable Yarn Cutter;
Disable Yarn Cutter;
Change Colour.

9. A tufting machine according to claim 1, wherein the tufting needle is mounted in the tufting mechanism in a manner that allows it to be rotated freely in either direction about its axis.

10. A tufting machine according to claim 9, wherein the foot and needle comprise interengaging formations by which the needle is driven in rotation by the foot.

11. A tufting head, comprising:

a tufting mechanism having a cyclic mode of operation;

a foot to engage backing fabric during tufting; and a hollow needle mounted in the mechanism that is moveable relative to the foot in a reciprocating manner to insert a tufi of yarn into backing fabric in each cycle;

wherein the needle is mounted in the tufting mechanism in a manner that allows it to be rotated freely in either direction about its axis; and, the foot and needle comprise interengaging formations by means of which the needle may be driven in rotation by the foot.

12. A tufting head according to claim 11, wherein the foot is in the form of a yoke that extends across the axis of the needle, and the needle may pass through a hole in the yoke.

13. A tufting head according to claim 12, wherein the formations on the needle comprise flats on its outer surface and the formations on the foot are in form of tabs on the inner surface of the hole that engage the flats on the needle.

14. A tufting head for use in a tufting machine in accordance with claim 1, wherein the foot is operable to engage the backing fabric during tufting, the needle is mounted in the tufting mechanism in a manner that allows it to be rotated freely in either direction about its axis, and the foot and needle comprise interengaging formations to enable the needle to be driven in rotation by the foot.

15. A tufting head according to claim 14, wherein the foot is in the form of a yoke that extends across the axis of the needle, and the needle may pass through a hole in the yoke.

16. A tufting head according to claim 15, wherein the formations on the needle comprise flats on its outer surface and the formations on the foot are in form of tabs on the inner surface of the hole that engage the flats on the needle.

17. A tufting machine according to claim 1, wherein the hollow needle is rotatable such that a tip of the needle faces the direction of tufting.

* * * * *

UNITED STATES PATENT AND TRADEMARK OFFICE

CERTIFICATE OF CORRECTION

PATENT NO. : 7,218,987 B2
APPLICATION NO. : 11/315142
DATED : May 15, 2007
INVENTOR(S) : Jez et al.

It is certified that error appears in the above-identified patent and that said Letters Patent is hereby corrected as shown below:

On the Title Page, under (12)
Change "Mile" to -- Jez --

On the Title Page (75)

The inventorship names are changed (corrected) from:

"Joz Mile
William Brian Wilson"

to

-- Mile Jez
William Brian Wilson --

Signed and Sealed this

Twenty-ninth Day of April, 2008

JON W. DUDAS
*Director of the United States Patent and Trademark Office*